US007267591B2

(12) United States Patent
Kimura et al.

(10) Patent No.: US 7,267,591 B2
(45) Date of Patent: Sep. 11, 2007

(54) OUTBOARD MOTOR

(75) Inventors: Sakayuki Kimura, Shizuoka-ken (JP); Naoya Murai, Shizuoka-ken (JP); Hideaki Matsushita, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/453,648

(22) Filed: Jun. 15, 2006

(65) Prior Publication Data

US 2006/0286876 A1 Dec. 21, 2006

(30) Foreign Application Priority Data

Jun. 15, 2005 (JP) ..... 2005-175375

(51) Int. Cl.
*B63H 21/36* (2006.01)

(52) U.S. Cl. ..... 440/77; 440/88 A

(58) Field of Classification Search ..... None
See application file for complete search history.

(56) References Cited

U.S. PATENT DOCUMENTS 4,952,180 A * 8/1990 Watanabe et al. ..... 440/77
5,340,343 A * 8/1994 Kawamukai et al. ..... 440/77
5,992,368 A 11/1999 Okamoto
7,118,432 B2 * 10/2006 Katayama ..... 440/77
2004/0149241 A1 8/2004 Shomura et al.

FOREIGN PATENT DOCUMENTS

JP 10-153151 6/1998
JP 2004-239156 8/2004

OTHER PUBLICATIONS

Specification and Drawings of U.S. Appl. No. 11/435,699, filed May 16, 2006.
Specification and Drawings of U.S. Appl. No. 11/314,924, filed Dec. 20, 2005.

* cited by examiner

*Primary Examiner*—Lars A. Olson
(74) *Attorney, Agent, or Firm*—Knobbe, Martens, Olson & Bear, LLP

(57) ABSTRACT

An outboard motor includes an engine having an air intake device. The cowling has an engine room in which the engine is disposed. One or more air intake openings are formed through the cowling. A water separation device is included in the cowling interposed between the air intake opening and the engine room. A first intake passage of the water separator communicates with the ambient air opening. A second intake passage communicates with an upper portion of the first intake passage. If a large flow of water enters the first intake passage through the air opening, such water flows out of the cowling through another opening and/or into a holding chamber formed in the cowling so as not to flow into the second intake passage.

20 Claims, 11 Drawing Sheets

OUTBOARD MOTOR

CROSS-REFERENCE TO RELATED APPLICATIONS

This application is based on and claims priority under 35 U.S.C. § 119 to Japanese Patent Application No. Ser. 2005-175375, filed on Jun. 15, 2005, the entire contents of which are hereby expressly incorporated by reference.

BACKGROUND OF THE INVENTION

1. Field of the Invention

The present invention relates generally to an outboard motor having a cowling, and more particularly to an outboard motor having a cowling that encloses an engine and defines an air intake passage through which the ambient air from outside the cowling is delivered to the engine.

2. Description of the Related Art

Typically, outboard motors are mounted on a transom board of an associated watercraft. Such an outboard motor typically has an engine for powering a propulsion device such as, for example, a propeller that generates thrust force for the watercraft. A cowling typically surrounds the engine for protecting the engine.

The engine requires air for combustion. Thus, in prior outboard motors, the cowling allows ambient air from outside the cowling to enter an internal space thereof in which the engine is positioned (i.e., engine room). On the other hand, it is undesirable to have water enter the engine air intake. Thus, cowlings typically attempt to block splashing water from entering the internal space. In order to block the water from entering the internal space, prior cowlings have a structure for separating water from the air.

One prior cowling has side air ducts on both lateral sides of the cowling, and air taken from right and left sides is introduced into stages of a two-stage structured intake chamber having an upper and a lower stage. A flow direction of the air is changed by the two-stage structured intake chamber to separate the water from the air. The separated air is then introduced into an engine room.

Occasionally, however, a relatively large wave may surmount the entire body of the outboard motor. When this happens, a large amount of water may enter the water separating structure. A conventional water separating structure likely cannot block such a large amount of water; thus, some of the water may enter the engine room, and the engine may intake water with the air.

SUMMARY OF THE INVENTION

A need thus exists for an outboard motor that can prevent water from entering an internal space of a cowling where an engine is placed (i.e., engine room), even when a large quantity of water suddenly surmounts the cowling.

The present invention can apply to an outboard motor having an intake passage for introducing ambient air to an engine room, the ambient air being taken through an ambient air opening formed in a cowling which encloses an engine. Even though water may enter through the ambient air opening when the outboard motor is temporarily covered with water, the water can be prevented from entering an engine room.

In accordance with one embodiment, the present invention provides an outboard motor comprising an engine and a cowling enclosing the engine and having a water separator device. The engine is disposed in an engine room defined between a cowling wall and the water separator. The cowling has a first ambient air opening and a second ambient air opening for taking in ambient air. An elongate first intake passage has a first end that communicates with the first ambient air opening and a second end that communicates with the second ambient air opening. The first passage has an upper wall with a port formed therethrough. The port is disposed between the first and second ends. A second intake passage communicates with the upper wall port and having an outlet opening into the engine room.

In another embodiment, a cross sectional area of a portion of the first passage between the first and second ends is greater than a cross sectional area of the first passage at one of the first and second ends.

In still another embodiment, the second intake passage comprises an intake chamber communicating with the upper wall port, and an air passage communicating air from the intake chamber to the engine room. In another embodiment, the intake chamber is vertically above the first intake passage.

In yet another embodiment, the port is disposed about halfway between the first and second ends. In another embodiment, a baffle extends upwardly from the upper wall adjacent the port. In still another embodiment, the first intake passage extends in a generally fore-to-aft direction.

In accordance with another embodiment, the present invention provides an outboard motor comprising an engine and a cowling enclosing the engine and having a water, separator device. The engine is disposed in an engine room defined between a cowling wall and the water separator. The cowling has an ambient air opening for taking in ambient air and an elongate first intake passage having a first end that communicates with the first ambient air opening and a second end that communicates with a water chamber. The water chamber defines a volume. The first passage has an upper wall with a port formed therethrough. The port is disposed between the first and second ends. A second intake passage communicates with the upper wall port and communicates air from the port to the engine room.

In another embodiment, the water chamber extends generally downwardly from the first intake passage.

DETAILED DESCRIPTION OF PREFERRED EMBODIMENTS

Embodiments of an outboard motor according to the present invention will be discussed below based upon the accompanying drawings. Although embodiments discussed herein are preferred, the present invention is not limited to these embodiments.

Figure 1:
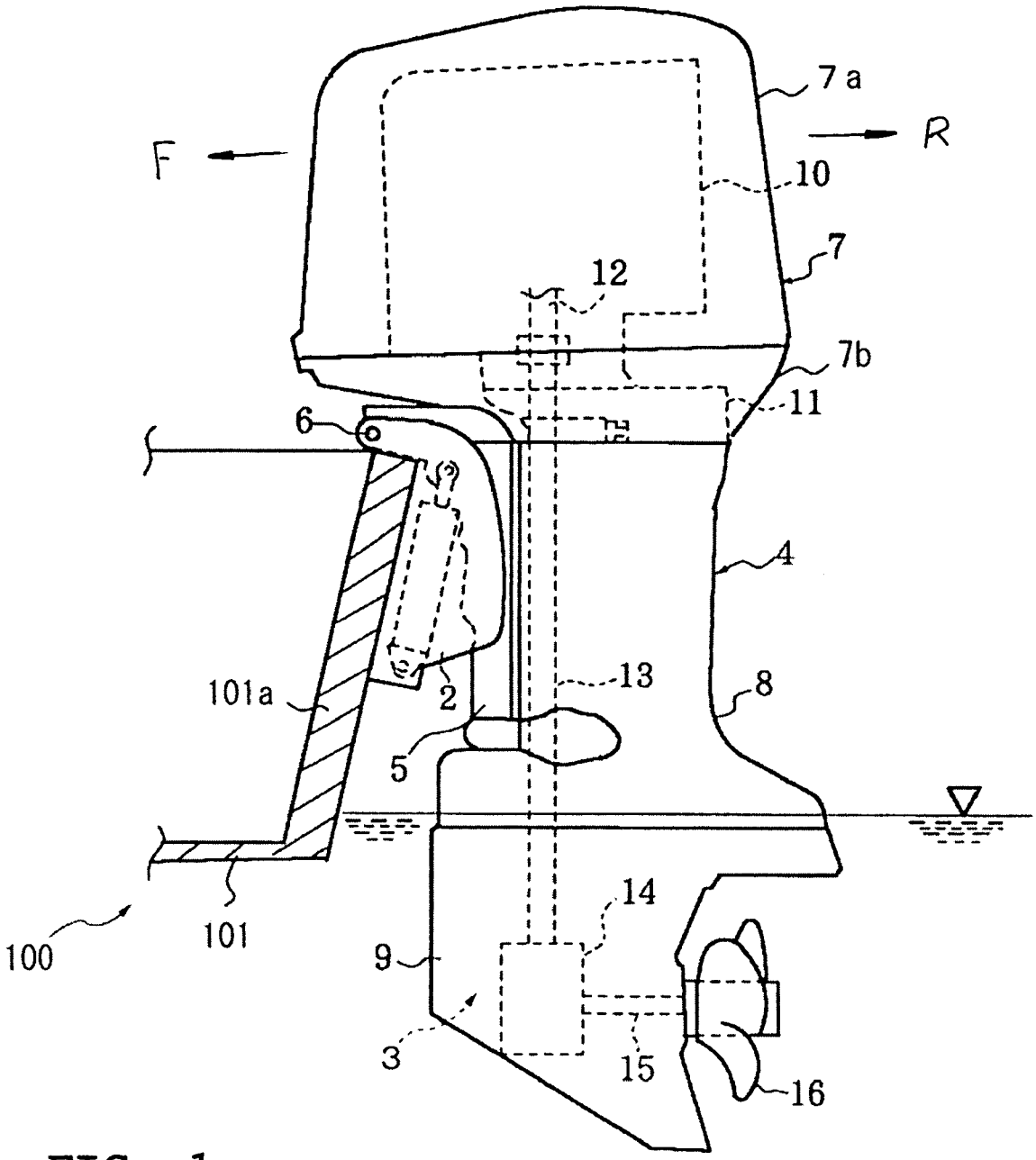
FIG. 1 is a side view generally showing a portion of a watercraft in cross section and an outboard motor according to the invention, the outboard motor being mounted on the watercraft.
Figure 2:
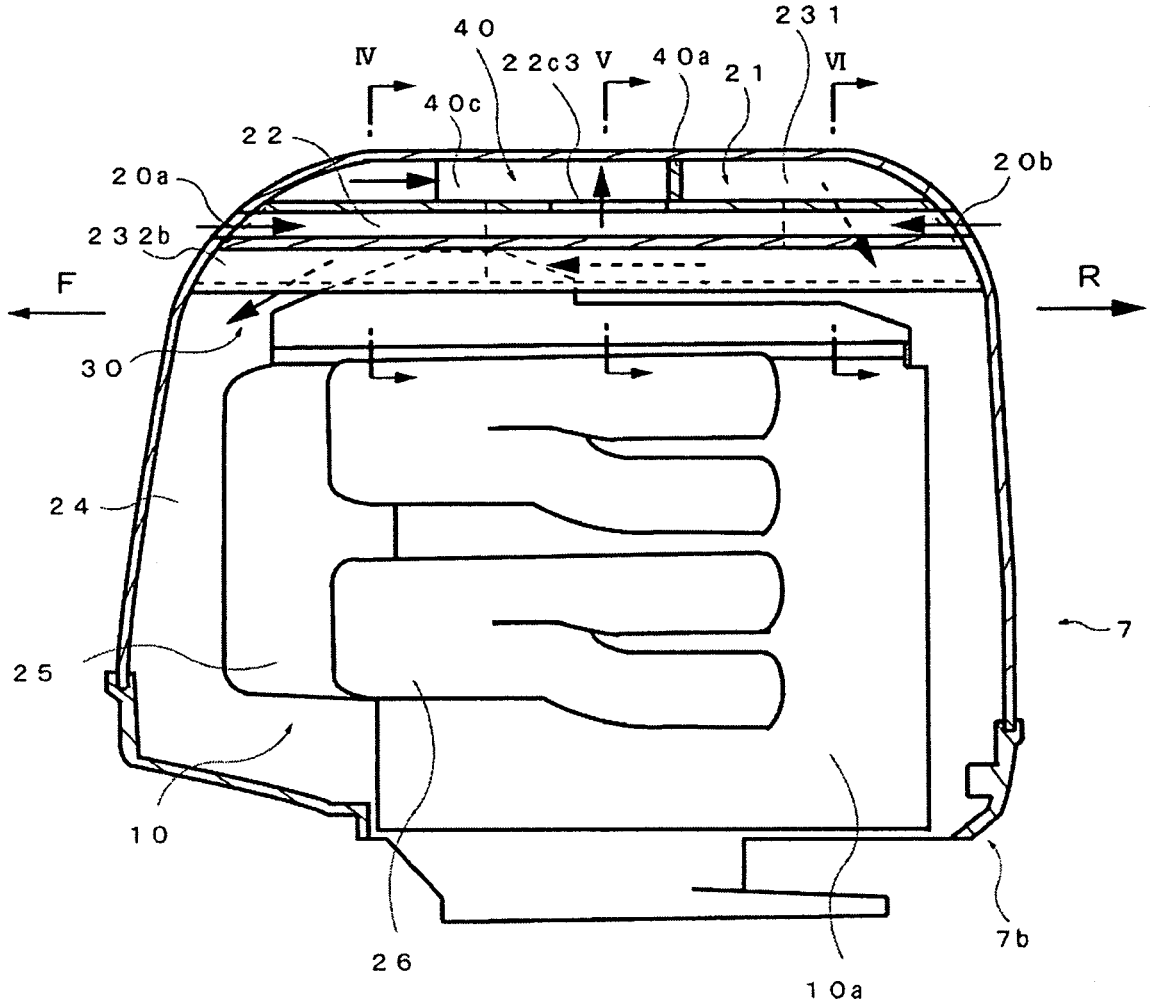
FIG. 2 is a cross sectional view of an upper part of the outboard motor of in FIG. 1.
Figure 3:
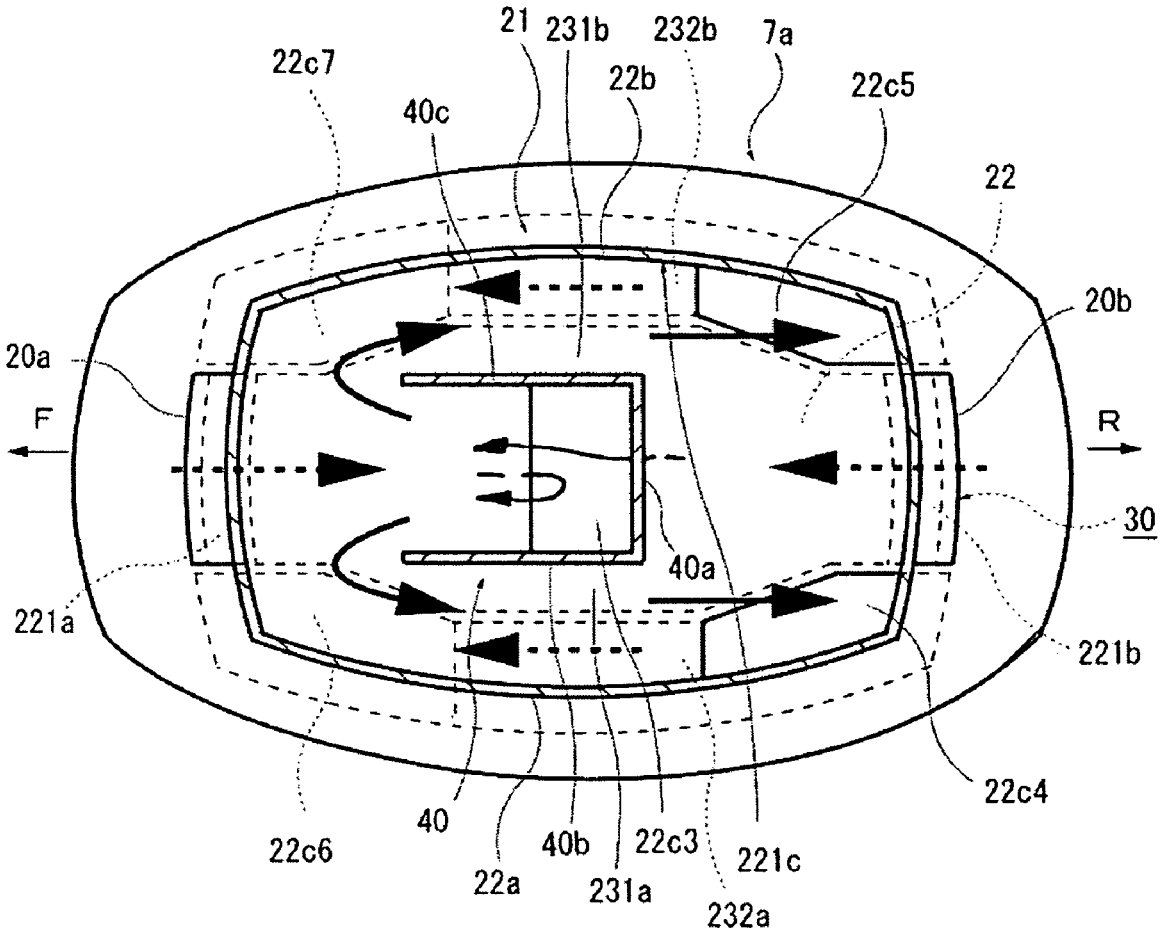
FIG. 3 is a top plan view of the upper part of the outboard motor of FIG. 1.
Figure 4:
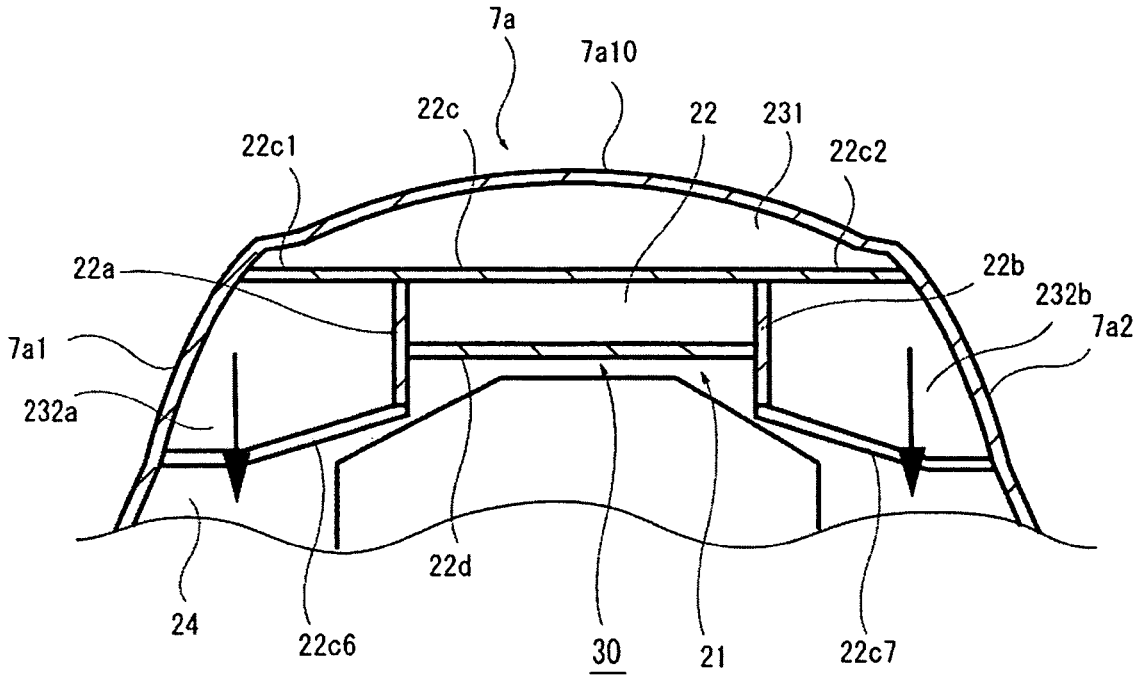
FIG. 4 is a cross sectional view, taken along the line IV-IV of FIG. 2.
Figure 5:
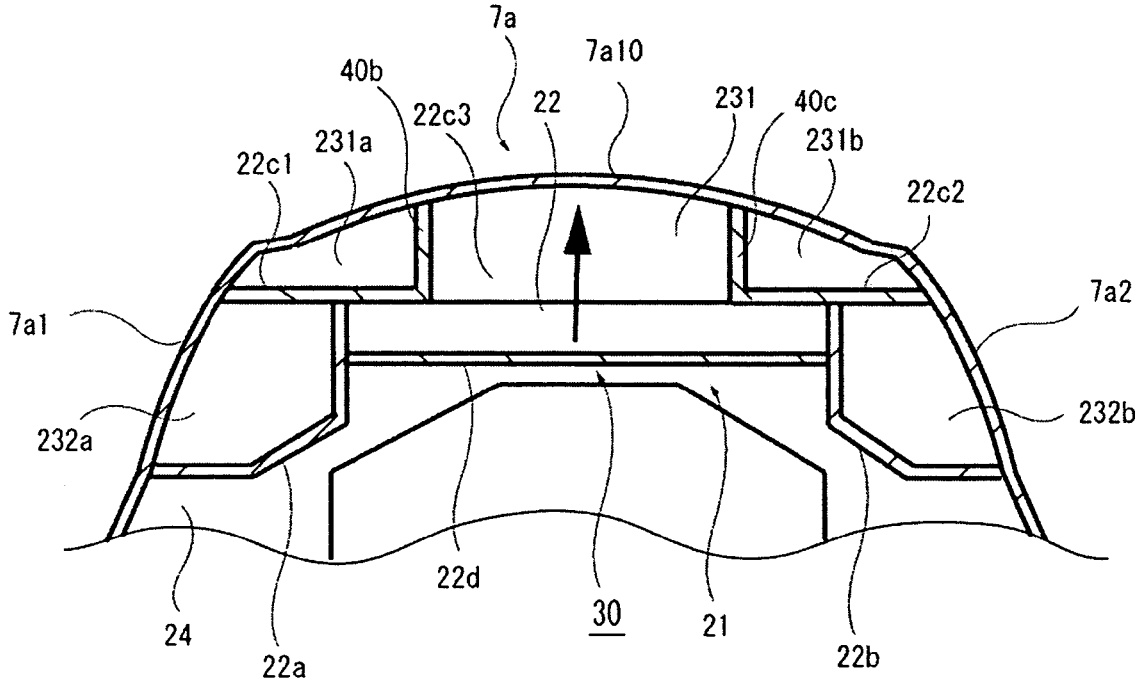
FIG. 5 is a cross sectional view, taken along the line V-V of FIG. 2.
Figure 6:
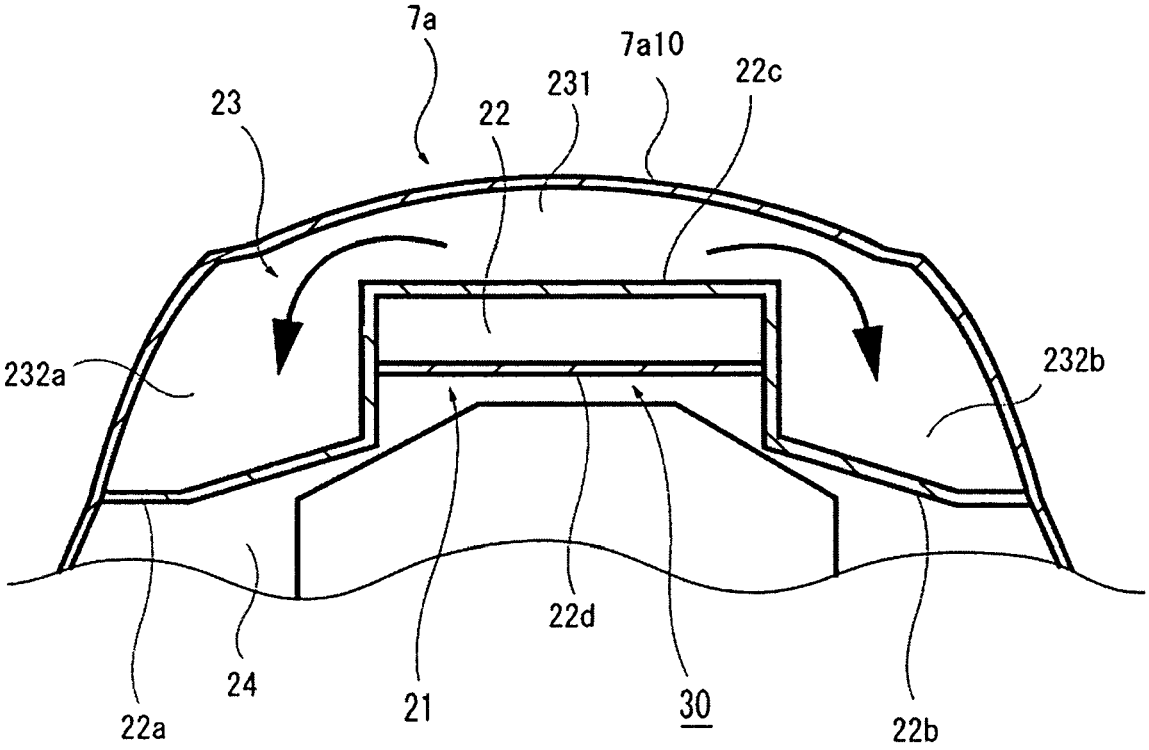
FIG. 6 is a cross sectional view, taken along the line VI-VI of FIG. 2.
Figure 7:
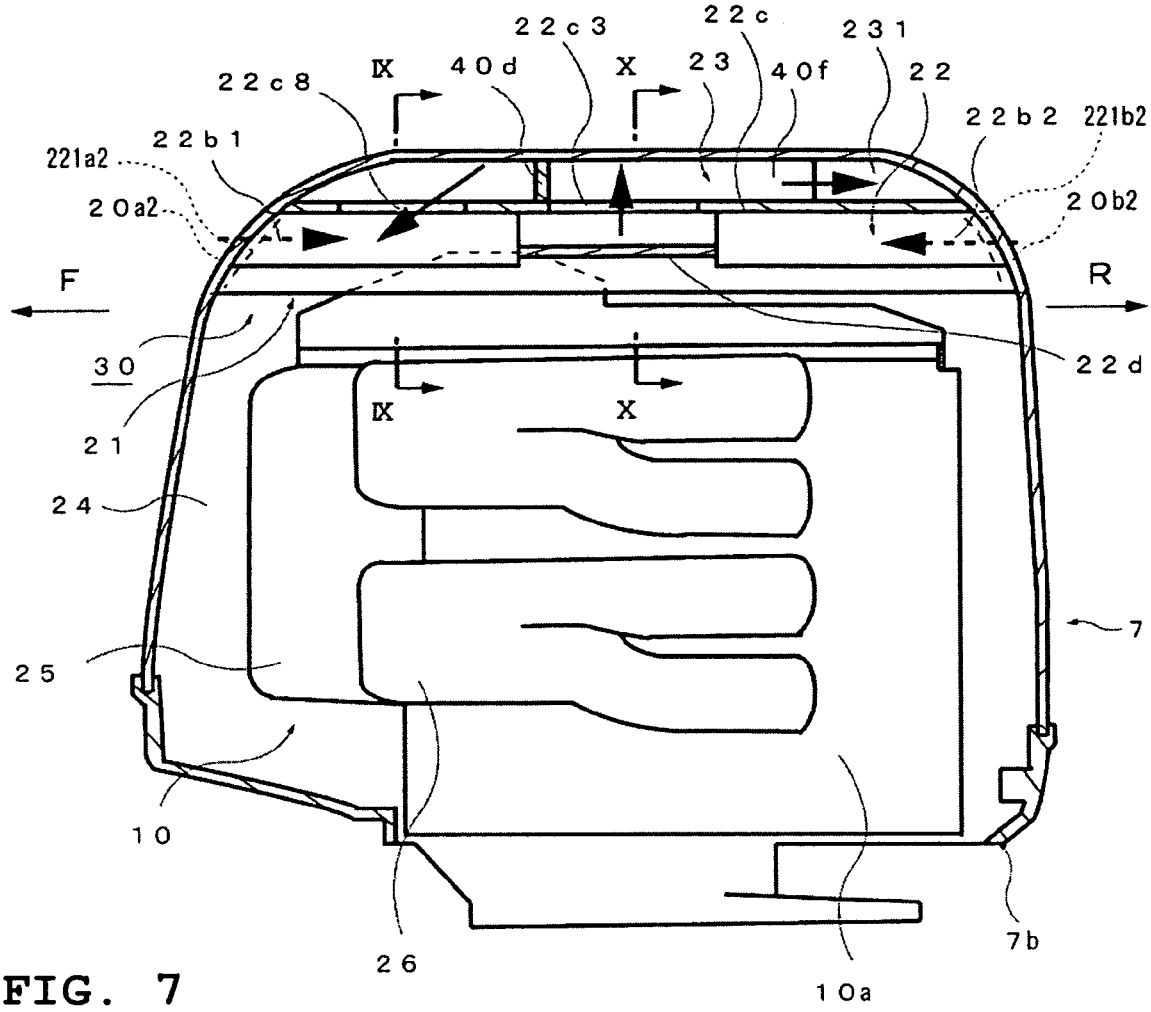
FIG. 7 is a cross sectional view of an upper part of another embodiment of an outboard motor.
Figure 8:
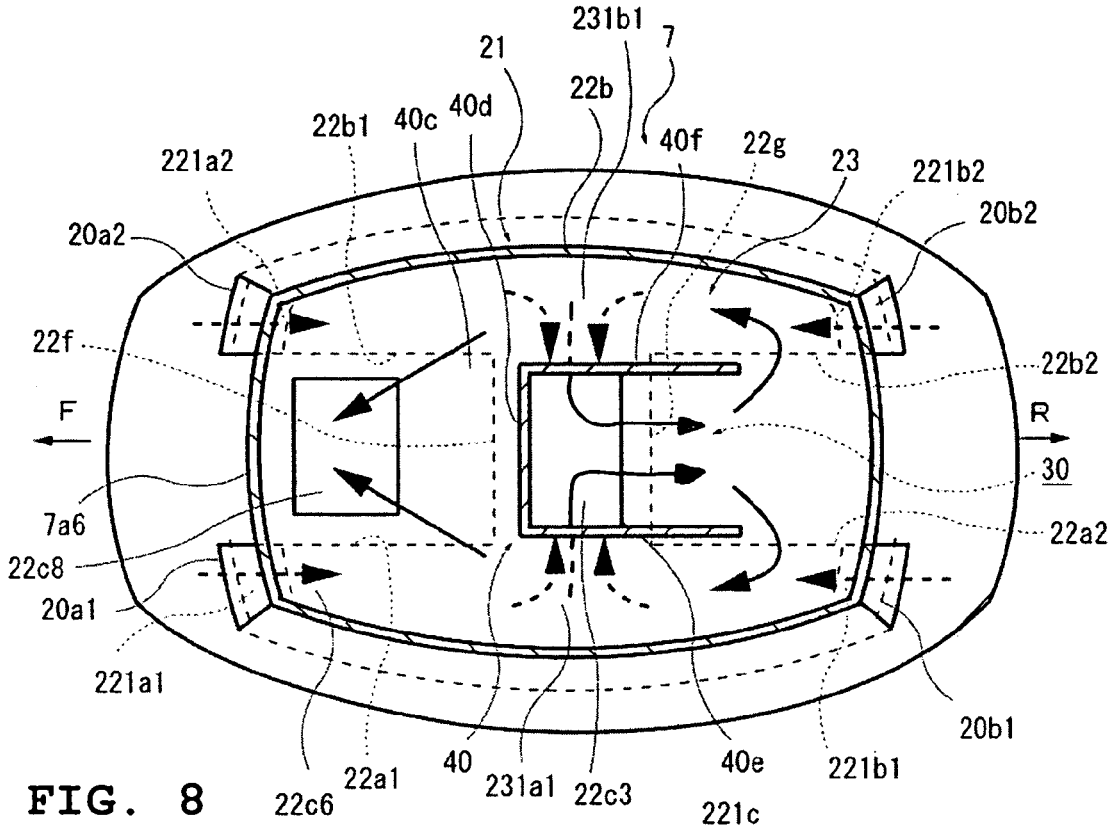
FIG. 8 is a top plan view of the upper part of the outboard motor of FIG. 7.
Figure 9:
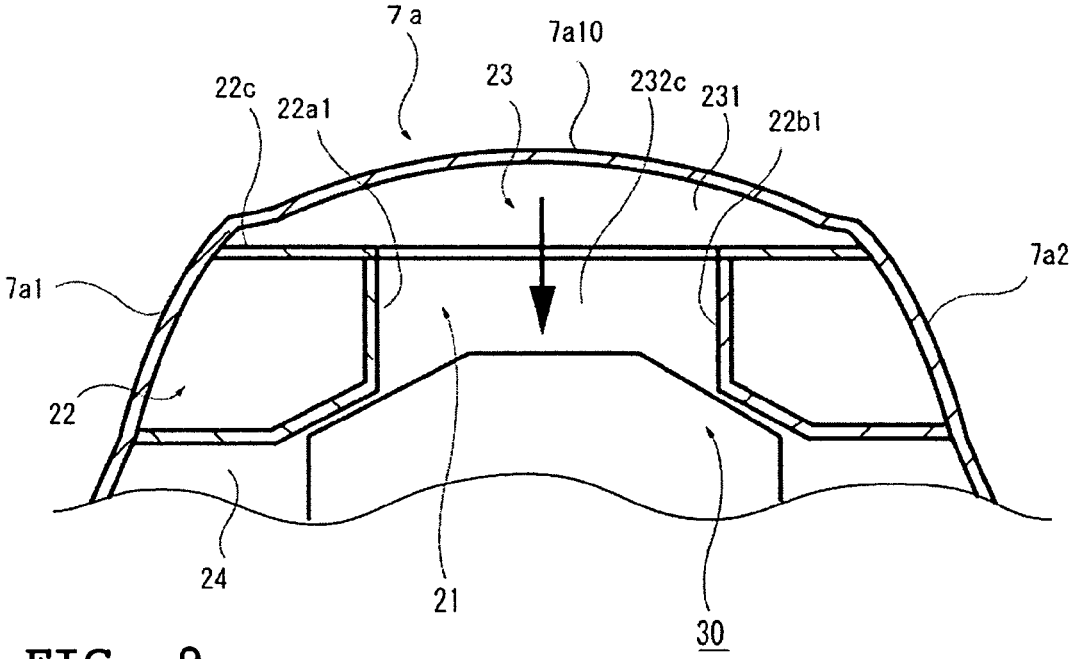
FIG. 9 is a cross sectional view, taken along the line IX-IX of FIG. 7.
Figure 10:
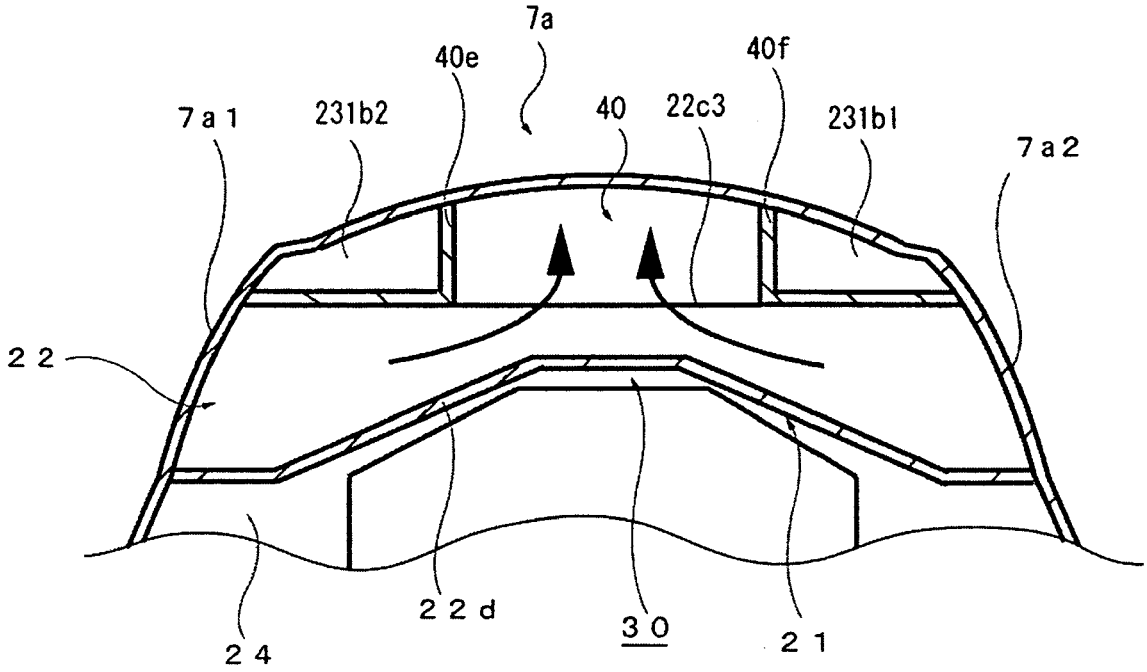
FIG. 10 is a cross sectional view, taken along the line X-X of FIG. 7.

FIG. 1 is a side elevational view of an outboard motor according to the present invention, which is mounted on a watercraft. In the figures, the reference symbol "F" indicates a front side or watercraft side (advance direction), while the reference symbol "R" indicates a rear side or anti-watercraft side (reverse direction). The outboard motor 1 preferably is mounted on a transom board 101*a* provided for a hull 101 of the watercraft 100 using a clamp bracket 2. The clamp bracket 2 carries a swivel bracket 5 elastically supporting a propulsion unit 4 of the outboard motor 1, the swivel bracket being pivotally mounted about a tilt shaft 6.

The propulsion unit 4 has a housing including a cowling 7, an upper case 8 and a lower case 9. The cowling 7 has a top cowling member 7*a* and a bottom cowling member 7*b*. The cowling 7 encloses a four-stroke engine 10. The upper case 8 is attached to a lower portion of an exhaust guide 11. The exhaust guide 11 supports the engine 10.

The engine 10 has a crankshaft 12 extending vertically. A top end of a drive shaft 13 extending vertically in the upper case 8 is coupled with the crankshaft 12. A bottom end of the drive shaft 13 is coupled with a forward-reverse changeover mechanism 14 enclosed by the lower case 9. A propeller shaft 15 extends horizontally from the forward-reverse changeover mechanism 14. A propeller 16 is attached to a rear end portion of the propeller shaft 15 extending out of the lower case 9.

With reference next to FIGS. 2-6, the outboard motor 1 includes the cowling 7 enclosing the engine 10. The cowling 7 has ambient air taking openings 20*a*, 20*b* formed therein, and an intake passage 21 for introducing the ambient air taken through the openings 20*a*, 20*b* into an engine room 24.

The cowling 7 has the top cowling member 7*a* and the bottom cowling member 7*b*. A front side of the top cowling member 7*a* has ambient air taking opening 20*a*, while a rear side of the top cowling member 7*a* has ambient air taking opening 20*b*. Ambient air from outside the cowling 7 is taken through the ambient air taking openings 20*a*, 20*b* and is eventually introduced into the engine room 24 through the intake passage 21 to be used as the air for the engine 10.

The engine 10 preferably is disposed in the engine room 24 in such a manner that cylinders 10*a* are positioned on the rear side and a silencer 25 is positioned on the front side. Respective intake pipes 26 are connected to the silencer 25. The respective intake pipes 26 are connected to the cylinders 10*a* of the engine 10. The air in the engine room 24 enters the silencer 25 and is delivered to the cylinders 10*a* of the engine 10 through the respected intake pipes 26 via the silencer 25.

With continued reference to FIGS. 2-6, the illustrated outboard motor I comprises a duct unit 30 set in the interior of the top cowling member 7*a* to shape the intake passage 21 using, for example, adhesive. The duct unit 30 preferably is unitarily formed from, for example, synthetic resin or sheet metal. The intake passage 21 preferably includes a fore-to-aft intake passage 22 extending fore to aft and extending between and communicating with the ambient air openings 20*a*, 20*b*, and an introducing intake passage 23 for introducing the air into the engine room 24, the introducing intake passage 23 communicating with an upper side of the fore-to-aft intake passage 22. Preferably, the introducing passage 23 communicates with the fore-to-aft passage 22 at about its midpoint.

In the illustrated embodiment, the fore-to-aft intake passage 22 is positioned generally in a center position of the top cowling member 7*a* in a width direction and is defined by a left wall 22*a*, a right wall 22*b*, an upper wall 22*c* and a lower wall 22*d*. The left wall 22*a* and the right wall 22*b* extend downward and then outwardly so that portions of the left and right walls 22*a*, 22*b* contact upper side portions 7*a*1, 7*a*2, respectively, of the top cowling member 7*a*.

The upper wall 22*c* extends beyond the left wall 22*a* and the right wall 22*b* in the width direction, and both ends of the upper wall 22*c* contact the upper side portions 7*a*1, 7*a*2 of the top cowling member 7*a* so as to be put together. The lower wall 22*d* is interposed between and coupled with the left wall 22*d* and the right wall 22*b*.

The fore-to-aft intake passage 22 has inlet ports 221*a*, 221*b* at both ends. The inlet port 221*a* communicates with the ambient air taking opening 20*a* on the front side, while the inlet port 221*b* communicates with the ambient air taking opening 20*b* on the rear side.

The introducing intake passage 23 is constructed to involve an intake chamber 231 in communication with the upper side portion of the fore-to-aft intake passage 22. A right and a left communicating passage 232*b* and 232*a* connect the intake chamber 231 to the engine room 24. The intake chamber 231 is defined by a space between the upper wall 22*c* and a roof 7*a*10 of the top cowling member 7*a*. The intake chamber 231 preferably is positioned generally vertically above the fore-to-aft intake passage 22 and the pair of the right and left communicating passages 232*b* and 232*a*.

The communicating passage 232*a* on the left side is defined by a space surrounded by the left wall 22*a*, a left side portion 22*c*1 of the upper wall 22*c* and the upper side portion 7*a*1 of the top cowling member 7*a*. The communicating passage 232*b* on the right side is formed with a space surrounded by the right wall 22*b*, a right side portion 22*c*2 of the upper wall 22*c* and the upper side portion 7*a*2 of the top cowling member 7*a*.

A center portion of the upper wall 22*c* has a rectangular center opening 22*c*3. A baffle 40 preferably is placed between the upper wall 22*c* and the roof 7*a*10 of the top cowling member 7*a*. A rear partition 40*a* of the baffle 40 extends along a rear side of the center opening 22*c*3, while right and left side partitions 40*c*, 40*b* extend along right and left sides of the center opening 22*c*3. The right and left side partitions 40*c*, 40*b* preferably extend forward beyond a front side of the center opening 22*c*3. Preferably, no portion of the baffle 40 extends downwardly from the upper wall 22*c*.

With continued reference to FIGS. 2-6, the upper side portion of the fore-to-aft intake passage 22 and the intake chamber 231 communicate with each other through the center opening 22*c*3 and the baffle 40. The intake chamber 231 and the communicating passage 232*a* on the left side communicate with each other through a rear opening 22*c*4 positioned on the left side and formed in a rear portion. The intake chamber 231 and the communicating passage 232*b* on the right side communicate with each other through a rear opening 22*c*5 positioned on the right side and formed in the rear portion. The communicating passage 232*a* on the left side communicates with the engine room 24 through a front opening 22*c*6 positioned on the left side and formed in a front portion. The communicating passage 232*b* on the right side communicates with the engine room 24 through a front opening 22*c*6 positioned on the right side and formed in the front portion.

In the illustrated embodiment, the fore-to-aft intake passage 22 extends fore to aft and is open at both ends. Thus, when the outboard motor I is covered with water because, for example, a large following wave comes and surmounts the cowling 7 of the outboard motor 1, water can enter through the ambient air taking opening 20*b* positioned in the rear side, will flow through the passage 22 and out opening 20*a*.

Even if a large volume of water enters through one side of the ambient air taking opening 20*b* as noted above, the water will flow through the passage 22 and out through the other side. Because the air is taken from the upper side portion, i.e., the introducing intake passage 23 including the intake chamber 231 and the communicating passages 232*a*, 232*b* through the center opening 22*c*3 positioned generally longitudinally centrally along the fore-to-aft intake passage 22, the water is prevented from flowing into the engine room side unless and until the fore-to-aft intake passage 22 is filled with the water.

With specific reference to FIGS. 3-6, the fore-to-aft passage 22 widens significantly between the inlet ports 221*a*, 221*b*. As such, the cross sectional area of the internal portion 221*c* of the fore-to-aft intake passage 22 is larger than cross sectional areas of the respective inlet ports 221*a*, 221*b* of the fore-to-aft intake passage 22. Thus, even though water enters through the inlet ports 221*a*, 221*b*, it is unlikely that the internal portion 221*c* of the fore-to-aft intake passage 22 will be filled with the water to its upper surface.

The fore-to-aft intake passage 22 communicates with the intake chamber 231 through the center opening 22*c*3 at the upper side portion of its halfway section. The intake chamber 231 has detouring passages 231*a*, 231*b* which detour rightward and leftward, respectively, to navigate around the baffle plate 40. The air flows through the detouring passages 231*a*, 231*b* and enters the respective communicating passages 232*a*, 232*b* positioned below through the rear opening 22*c*4 on the left side and the rear opening 22*c*5 on the right side. The air in the communicating passage 232*a* on the left side is introduced into the engine room 24. through the front opening 22*c*6 on the left side, while the air in the communicating passage 232*b* on the right side is introduced into the engine room 24 through the front opening 22*c*6 on the right side.

Because the air is introduced through a tortuous, direction-changing passage in the manner discussed above, the water and the air are separated from each other in the intake chamber 231 of the upper side. The separated air can be introduced into the engine room 24 from the communicating passages 232*a*, 232*b*.

In the embodiment shown in FIGS. 2-6, the intake chamber 231 is positioned higher than the fore-to-aft intake passage 22 and the communicating passages 232*a*, 232*b*, and the air is taken at the upper side portion of the fore-to-aft intake passage 22. No water thus flows into the intake chamber 231 unless and until the fore-to-aft intake passage 22 is filled with the water. In addition, water entrained in the intake air is separated out in the intake chamber 231, and the separated air is introduced into the engine room 24 from the communicating passages 232*a*, 232*b*. Separated water may be drained from the chamber 231 through any draining structure.

With reference next to FIGS. 7-10, another embodiment has many components that are similar to those shown in FIGS. 2-6. Such similar components are assigned the same reference numerals and/or symbols, and descriptions about them are omitted. An outboard motor 1 in this embodiment has ambient air taking openings 20*a*1, 20*a*2 and 20*b*1, 20*b*2 at front and rear portions on right and left sides of a top cowling member 7*a*. An intake passage 21 is formed in such a manner that a duct unit 30 is set in the interior of the top cowling member 7*a* and is affixed using, for example, adhesive, mechanical fasteners, or the like.

The intake passage 21 includes a fore-to-aft intake passage 22 extending fore to aft and extending between and communicating with openings 20*a*1, 20*a*2, 20*b*1, 20*b*2, and an introducing intake passage 23 communicating with an upper side portion of the fore-to-aft intake passage 22 and introducing the air to an engine room 24.

The fore-to-aft intake passage 22 is a passage defined by left walls 7*a*1, 7*a*2 of the top cowling member 7*a*, a left side front wall 22*a*1, a left side rear wall 22*a*2, a right side front wall 22*b*1, a right side rear wall 22*b*2, an upper wall 22*c*, a lower wall 22*d*, a connecting front wall 22*f* and a connecting rear wall 22*g*. The connecting front wall 22*f* connects respective rear sides of the left side front wall 22*a*1 and the right side front wall 22*b*1 to each other. The connecting rear wall 22*g* connects respective front sides of the left side rear wall 22*a*2 and the right side rear wall 22*b*2 to each other, to thereby enlarge a cross sectional area of an internal portion 221*c*1 of the fore-to-aft intake passage 22.

The fore-to-aft intake passage 22 has inlet ports 221*a*1, 221*a*2 and inlet ports 221*b*1, 221*b*2 on both lateral sides. The inlet ports 221*a*1, 221*a*2 communicate with the ambient air taking openings 20*a*1, 20*a*2 on the front side, while the inlet ports 221*b*1, 221*b*2 communicate with the ambient air taking openings 20*b*1, 20*b*2 on the rear side.

In the fore-to-aft intake passage 22, the cross sectional area of the internal portion 221*c* is larger than the sum of cross sectional areas of the one set of the outlet ports 221*a*1 and the outlet port 221*a*2, or the sum of cross sectional areas of the other set of the outlet ports 221*b*1 and the outlet port 221*b*2. Thereby, even though water may enter through the one set of the inlet port 221*a*1 and the inlet port 221*a*2 or through the other set of the inlet port 221*b*1 and the inlet port 221*b*2, the volume of water will be insufficient to fill the internal portion 221*c* of the fore-to-aft intake passage to its upper surface.

The introducing intake passage 23 is constructed to involve an intake chamber 231 communicating with the upper side portion of the halfway section of the fore-to-aft intake passage 22, and a communicating passage 232*c* connecting the intake chamber 231 and the engine room 24 to each other. The intake chamber 231 is defined by a space between an upper wall 22*c* and a roof 7*a*10 of the top cowling member 7*a*. The intake chamber 231 is positioned vertically higher than the fore-to-aft intake passage 22 and the communicating passage 232*c*.

The communicating passage 232*c* is defined by a space surrounded by the left side front wall 22*a*1, a right side rear wall 22*b*1, the connecting front wall 22*f* and a front portion

7*a*6 of the top cowling member 7*a*. The communicating passage 232*c* communicates with the intake chamber 231 through a front opening 22*c*8 of the upper wall 22*c*.

A center portion of the upper wall 22*c* has a rectangular center opening 22*c*3. A baffle 40 is placed between the upper wall 22*c* and the roof 7*a*10 of the top cowling member 7*a*. A front partition 40*d* of the baffle 40 extends along a front side of the center opening 22*c*3, while right and left partitions 40*e*, 40*f* extend along right and left sides of the center opening 22*c*3. The right and left partitions 40*e*, 40*f* extend rearward beyond a rear side of the center opening 22*c*3. The upper side portion of the halfway section of the fore-to-aft intake passage 22 and the intake chamber 231 communicate with each other through the center opening 22*c*3 and the baffle 40. The intake chamber 231 and the communicating passage 232*c* communicate with each other through a front opening 22*c*8 formed on the front side. The communicating passage 232*c* communicates with the engine room 24.

In this embodiment, water can enter through the ambient air taking openings 20*a*1, 20*a*2 positioned on the front side of the outboard motor 1 or the ambient air taking openings 20*b*1, 20*b*2 positioned on the rear side. However, even if a large volume of water enters through each one side of the front ambient air taking openings 20*a*1, 20*a*2 or the rear ambient air taking openings 20*b*1, 20*b*2 as noted above, the water will flow out through each other side. Because the air is taken from the upper side portion, i.e., the introducing intake passage 23 including the intake chamber 231 and the communicating passage 232*c* through the center opening 22*c*3 positioned in the halfway section of the fore-to-aft intake passage 22, the water does not flow into the engine room side unless and until the fore-to-aft intake passage 22 is filled with the water.

The cross sectional area of the internal portion 221*c* of the fore-to-aft intake passage 22 is larger than the sum of cross sectional areas of the respective inlet ports 221*a*1, 221*a*2 of the front ambient air taking openings 20*a*1, 20*a*2, or the sum of cross sectional areas of the respective inlet ports 221*b*1, 221*b*2 of the rear ambient air taking openings 20*b*1, 20*b*2. Thus, even though water enters through the inlet ports 221*a*1, 221*a*2 or the inlet ports 221*b*1, 221*b*2, the volume of such water flow will not be sufficient to fill the internal portion 221*c* of the fore-to-aft intake passage 22 to its upper surface unless such flow is sustained.

The fore-to-aft intake passage 22 communicates with the intake chamber 231 through the center opening 22*c*3, which is positioned generally longitudinally centrally in the passage 22. The intake chamber 231 has detouring passages 231*a*1, 231*b*1 which detour rightward and leftward to navigate around the baffle 40. The air flows through the detouring passages 23 1*a*1, 231*b*1 and enters the communicating passage 232*c* through the front opening 22*c*8. The front opening 22*c*8 is offset from the major flow of the water which enters, and the water does not flow thereinto. The air is introduced into the engine room 24 from the communicating passage 232*c*. Because the air is introduced in such a manner as discussed above, the water and the air are separated from each other in the intake chamber 231 located in an upper position. The separated, dry air is introduced into the engine room 24 from the communicating passage 232*c*.

Figure 11:
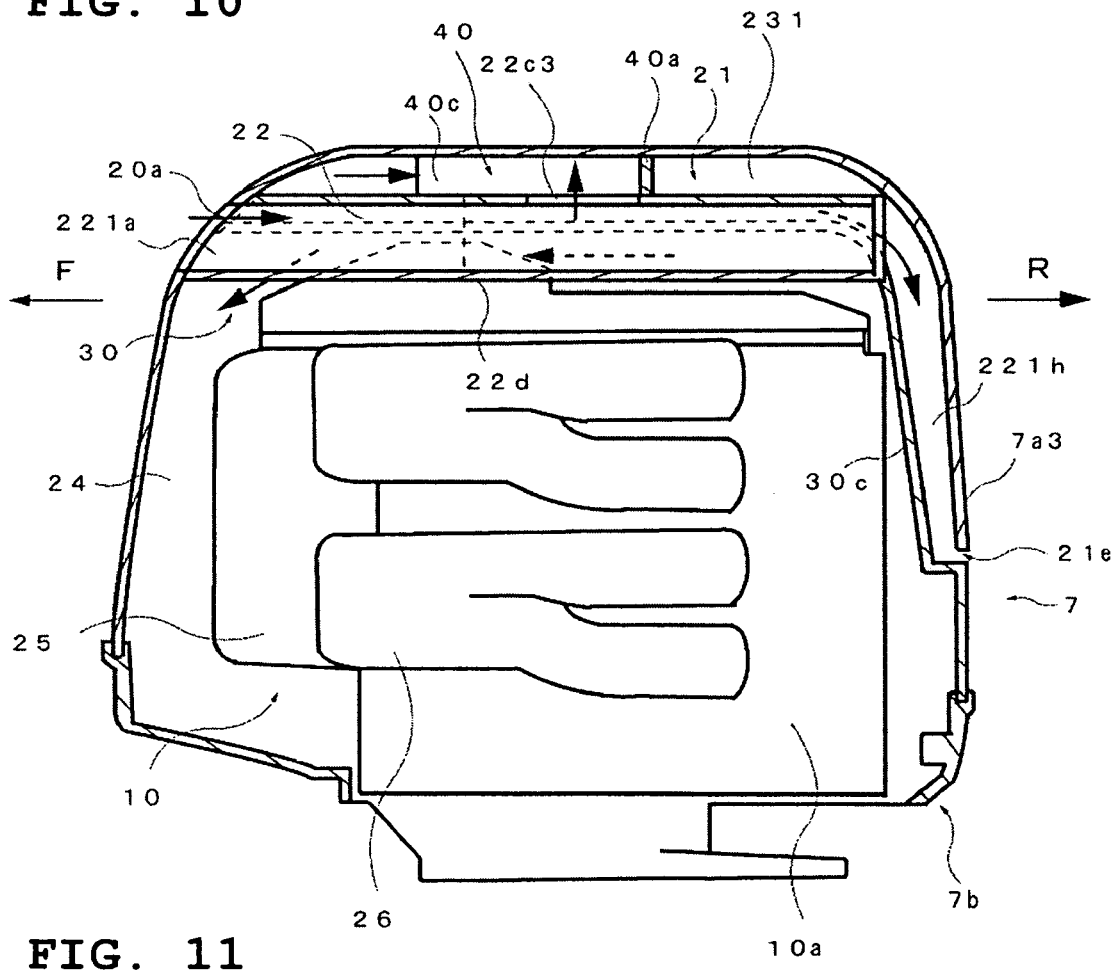
FIG. 11 is a cross sectional view of an upper part of a further embodiment of outboard motor.
Figure 12:
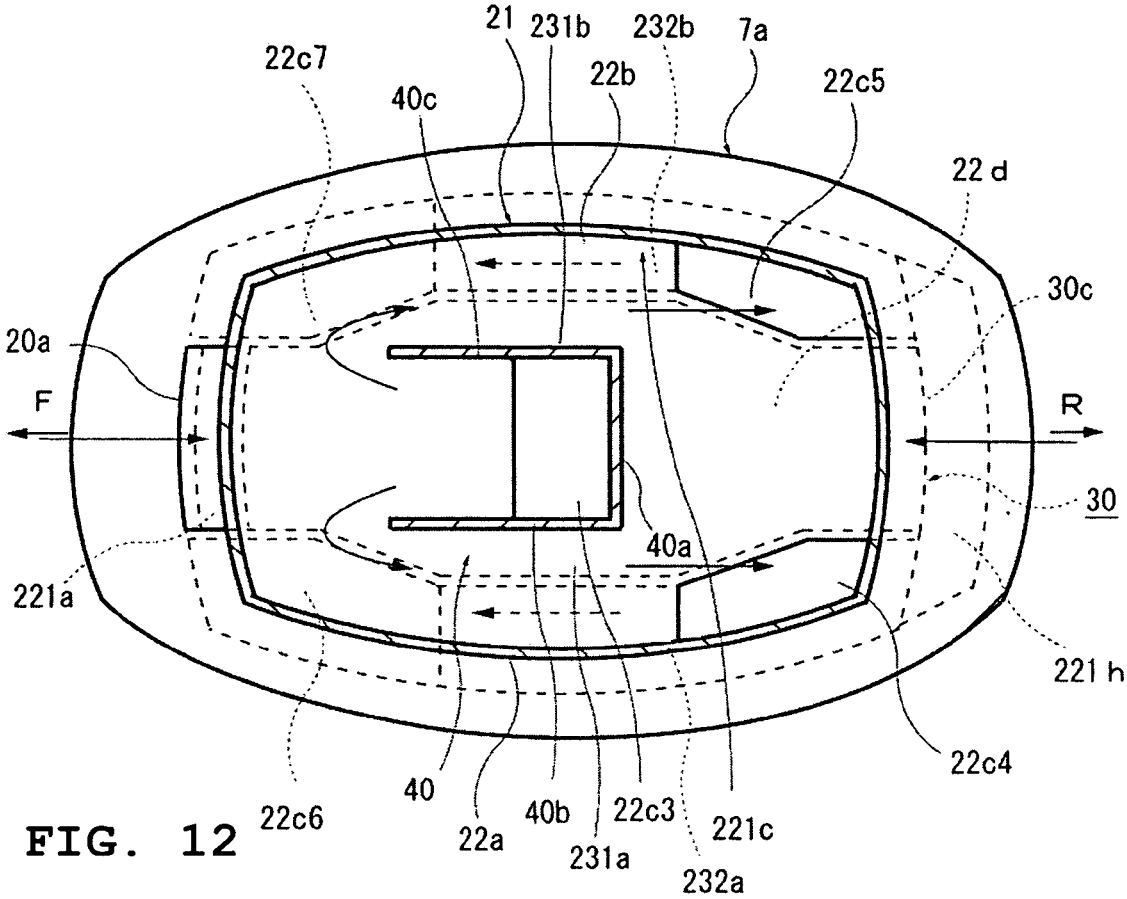
FIG. 12 is a top plan view of the upper part of the outboard motor of FIG. 11.
Figure 13:
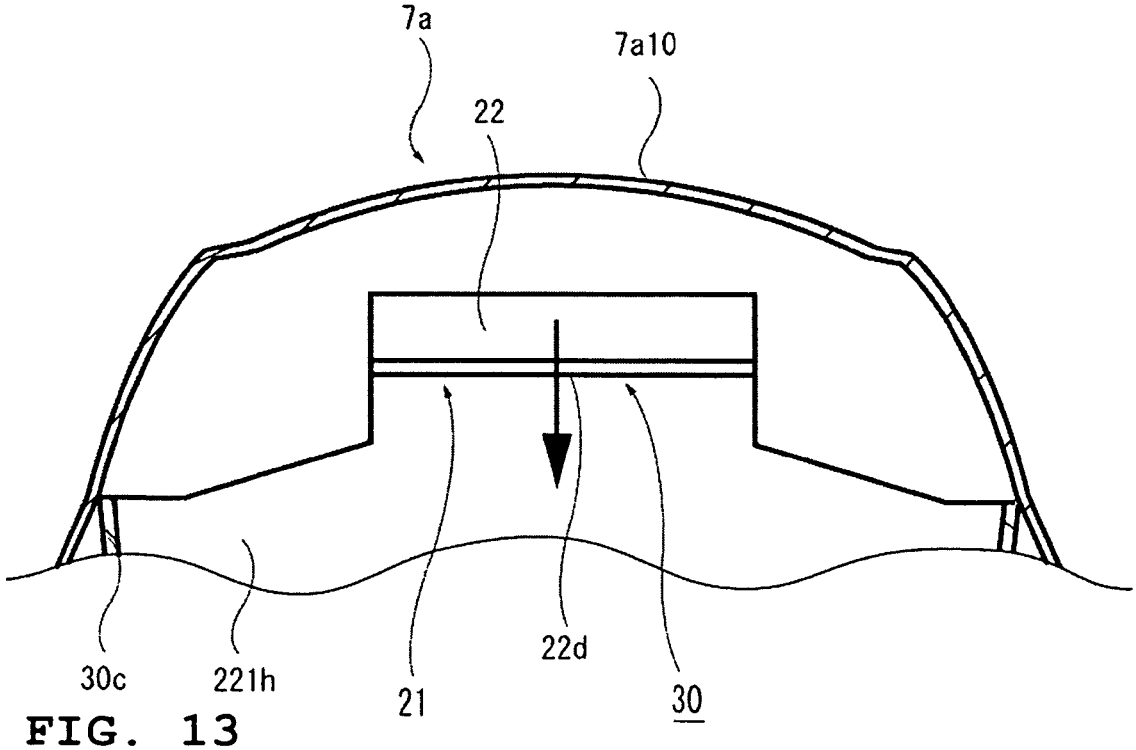
FIG. 13 is a cross sectional view of a chamber section of the outboard motor of FIG. 11.

With reference next to FIGS. 11-13, a further embodiment comprises components that are similar to those shown in FIGS. 2-6. Such similar components are assigned the same reference numerals and/or symbols, and descriptions about them are omitted. An intake passage 21 in this embodiment includes a fore-to-aft intake passage 22 and an introducing intake passage 23. Although the introducing intake passage 23 is constructed similarly as in the embodiment of FIGS. 2-6, the fore-to-aft intake passage 22 has an inlet port 221*a* on one side and a chamber 221*h* on the other side.

In the illustrated embodiment, the inlet port 221*a* is positioned in a front portion and the chamber 221*h* is positioned in a rear portion. In another embodiment, however, an ambient air taking opening 20 can be placed in the rear portion, the inlet port 221*a* can be placed in the rear portion and the chamber 221*h* can be placed in the front portion. A chamber forming member 30*c* is coupled with a rear end portion of a lower wall 22*d*. The chamber forming member 30*c* is fixed to a rear portion 7*a*3 of the top cowling member 7*a*. The chamber forming member 30*c* forms the chamber 221*h* between itself and the rear portion 7*a*3.

The chamber 221*h* extends vertically downward beyond the fore-to-aft intake passage 22. The chamber 221*h* is disposed between cylinders 10*a* of an engine 10 and the rear portion 7*a*3 of the top cowling member 7*a* of the cowling 7. As thus noted, the oblong chamber 221*h* having a large capacity can be provided between the engine 10 and the cowling 7 and moreover using the rear portion 7*a*3 of the top cowling member 7*a*. Because the chamber 221*h* extends vertically, a flood of water that may flow through the port 221*a* accumulates in the chamber 221*h*. Although the water flows into the chamber 221*h* and accumulates in the chamber 221*h*, the water is gradually discharged through a water discharging opening 21*e* formed in the rear portion 7*a*3 of the top cowling 7*a*.

In this embodiment, the fore-to-aft intake passage 22 extends fore to aft in the cowling 7. Even though a flood of water from a wave or the like may enter through the inlet opening 221*a* on the one side, the water flows into the chamber 221*h* on the other side as shown in FIG. 13, and it is very unlikely that the fore-to-aft intake passage 22 is filled with the water to its upper surface. The water thus can be prevented from flowing into the engine room 24, and only air is introduced into the engine room 24.

Figure 14:
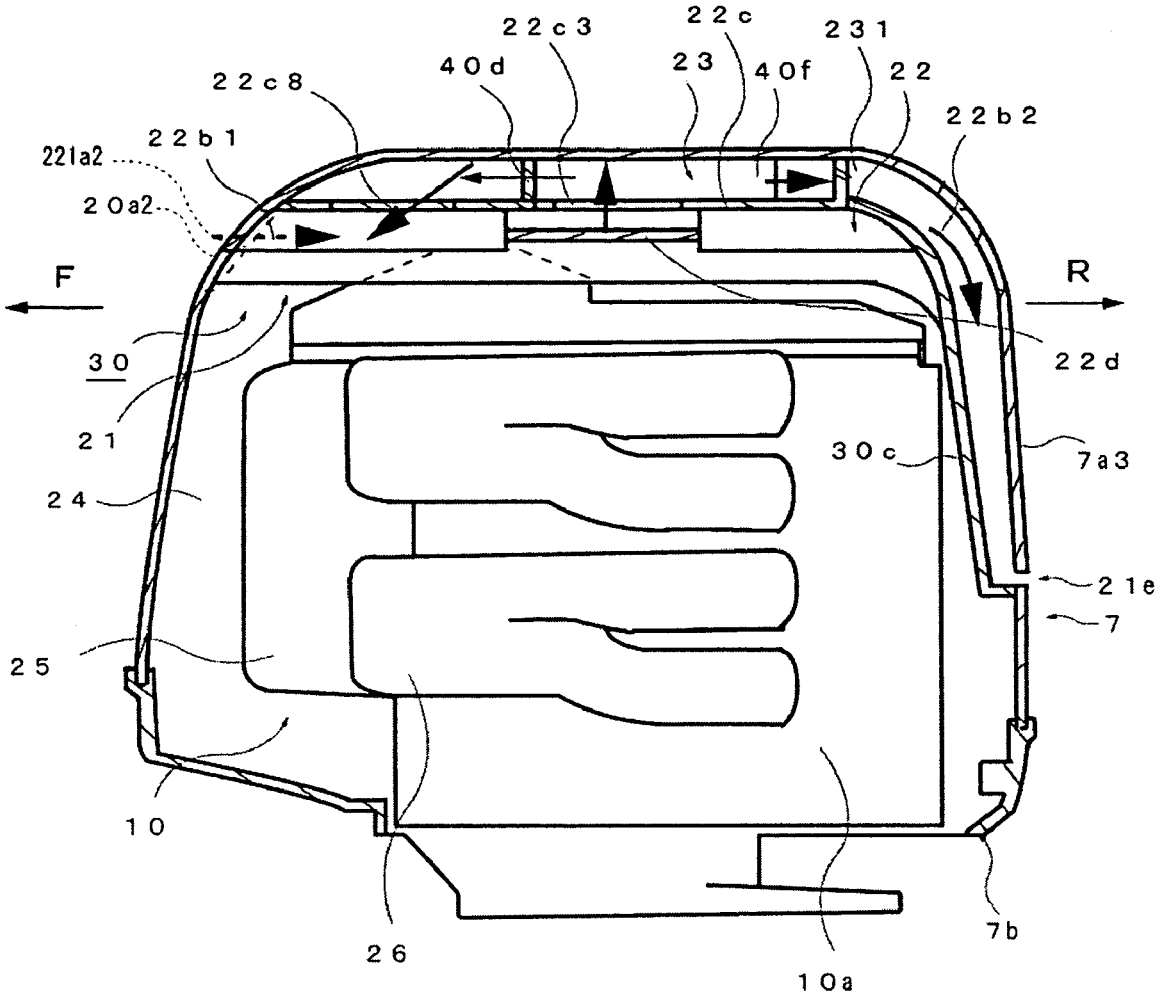
FIG. 14 is a cross sectional view of an upper part of a still further embodiment of an outboard motor.
Figure 15:
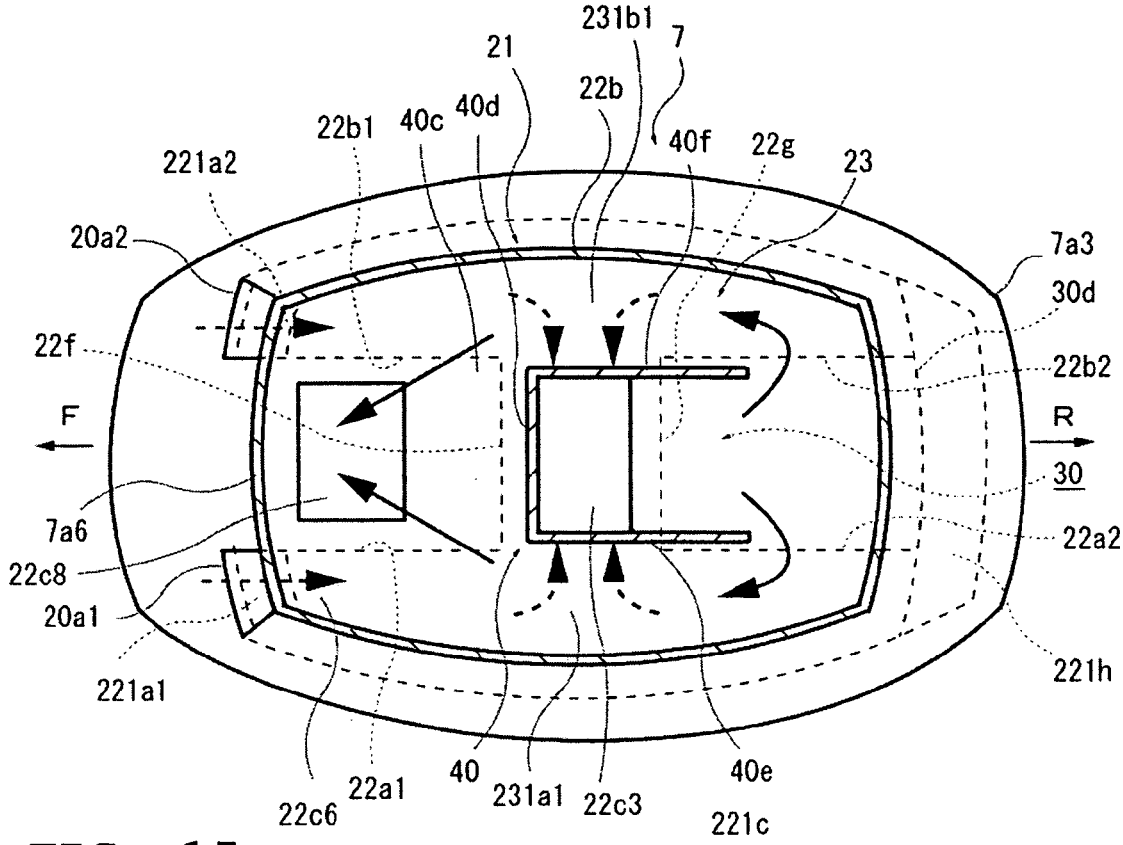
FIG. 15 is a top plan view of the upper part of the outboard motor of FIG. 14.
Figure 16:
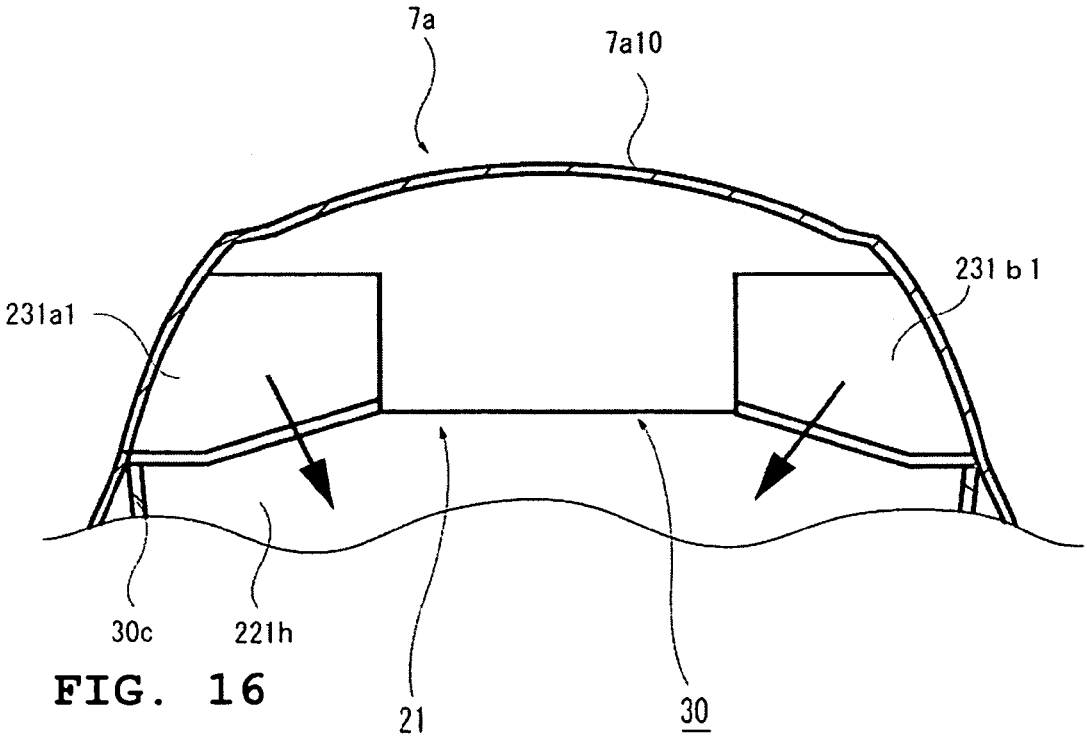
FIG. 16 is a cross sectional view of a chamber section of the outboard motor of FIG. 14.

With reference next to FIGS. 14-16, a further embodiment comprises components that are similar to those shown in FIGS. 7-10. Such components are assigned the same reference numerals and/or symbols, and descriptions about them are omitted. An intake passage 21 in this embodiment includes a fore-to-aft intake passage 22 and an introducing intake passage 23. Although the introducing intake passage 23 is constructed in the same way as the embodiment of FIGS. 7-10, the fore-to-aft intake passage 22 has inlet ports 221*a*1, 221*a*2 on one side and a chamber 221*h* on the other side.

In this embodiment, the inlet ports 221*a*1, 221*a*2 are positioned in a front portion and the chamber 221*h* is positioned in a rear portion. In another embodiment, the ambient air taking openings 20*a*1, 20*a*2 are placed in the rear portion, the inlet ports 221*a*1, 221*a*2 are placed in the rear portion and the chamber 221*h* is placed in the front portion. In the illustrated embodiment, chamber forming member 30*d* is coupled with a rear end portion of a lower wall 22*d*. The chamber forming member 30*d* is fixed to a rear portion 7*a*3 of the top cowling member 7*a*. The chamber forming member 30*d* forms the chamber 221*h* between itself and the rear portion 7*a*3.

In this embodiment, the fore-to-aft intake passage 22 extends fore to aft in the cowling 7. Even though a flood of water from a wave or the like may enter through the inlet openings 221*a*1, 221*a*2 on the one side, the water flows into the chamber 221*h* on the other side as shown in FIG. 16, and it is unlikely that the fore-to-aft intake passage 22 will fill with the water to its upper surface. The water thus can be prevented from flowing into the engine room 24, and only air is introduced into the engine room 24.

In the discussion above, the fore-to-aft passage as passages 22 have been described with specific structure extending generally along the longitudinal length of the outboard motor. It is to be understood that, in further embodiments, outboard motors can be constructed using the same inventive principles, but, for example, may use a passage that extends generally side-to-side, including ambient air openings formed through sidewalls of the cowling. Further, in the illustrated embodiments the passages have been illustrated generally symmetrical about longitudinal and/or transverse center lines of the outboard motor. It is to be understood that, in other embodiments, similar inventive principles may be employed, but the structure is not necessarily symmetrical.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising an engine and a cowling enclosing the engine and having a water separator device, the engine being disposed in an engine room defined between a cowling wall and the water separator, the cowling having a first ambient air opening and a second ambient air opening for taking in ambient air, an elongate first intake passage having a first end that communicates with the first ambient air opening and a second end that communicates with the second ambient air opening, the first passage having an upper wall with a port formed therethrough, the port disposed between the first and second ends, and a second intake passage communicating with the upper wall port and having an outlet opening into the engine room.

2. The outboard of claim 1, wherein a cross sectional area of a portion of the first passage between the first and second ends is greater than a cross sectional area of the first passage at one of the first and second ends.

3. The outboard of claim 2, wherein the first intake passage is wider at a longitudinal center of the passage than at either of the first or second ends of the passage.

4. The outboard of claim 2, wherein the second intake passage comprises an intake chamber communicating with the upper wall port, and an air passage communicating air from the intake chamber to the engine room.

5. The outboard of claim 4, wherein the intake chamber is vertically above the first intake passage.

6. The outboard of claim 1, wherein the port is disposed about halfway between the first and second ends.

7. The outboard of claim 6, wherein a baffle extends upwardly from the upper wall adjacent the port.

8. The outboard of claim 6, wherein the first intake passage extends in a generally fore-to-aft direction.

9. The outboard of claim 1, wherein the second intake passage comprises an intake chamber communicating with the upper wall port, and an air passage communicating air from the intake chamber to the engine room.

10. The outboard of claim 9, wherein the second intake passage defines a tortuous air flow path between the port and the outlet.

11. The outboard of claim 10, wherein the intake chamber is vertically above the first intake passage.

12. The outboard of claim 11, wherein the outlet of the second intake passage is vertically below the first intake passage.

13. An outboard motor comprising an engine and a cowling enclosing the engine and having a water separator device, the engine being disposed in an engine room defined between a cowling wall and the water separator, the cowling having an ambient air opening for taking in ambient air, an elongate first intake passage having a first end that communicates with the first ambient air opening and a second end that communicates with a water chamber, the water chamber defining a volume, the first passage having an upper wall with a port formed therethrough, the port disposed between the first and second ends, and a second intake passage communicating with the upper wall port and communicating air from the port to the engine room.

14. The outboard of claim 13, wherein a cross sectional area of a portion of the first passage between the first and second ends is greater than a cross sectional area of the first passage at the first end.

15. The outboard of claim 14, wherein the port is disposed about halfway between the first and second ends.

16. The outboard of claim 15, wherein the first intake passage extends in a generally fore-to-aft direction.

17. The outboard of claim 16, wherein the second intake passage comprises an intake chamber communicating with the upper wall port, and an air passage communicating air from the intake chamber to the engine room.

18. The outboard of claim 17, wherein the intake chamber is vertically above the first intake passage.

19. The outboard of claim 13, wherein the second intake passage comprises an intake chamber communicating with the upper wall port, and an air passage communicating air from the intake chamber to the engine room, and the intake chamber is vertically above the first intake passage.

20. The outboard of claim 19, wherein the water chamber extends generally downwardly from the first intake passage.

* * * * *